United States Patent [19]

Markham

[11] 4,023,151

[45] May 10, 1977

[54] COMMUNICATION APPLIANCE OPERATING DEVICE

[76] Inventor: Lucille J. Markham, 31 Cecelia Terrace, Rochester, N.Y. 14622

[22] Filed: Nov. 24, 1975

[21] Appl. No.: 634,851

Related U.S. Application Data

[63] Continuation-in-part of Ser. No. 569,148, April 17, 1975, abandoned.

[52] U.S. Cl. ..... 340/221; 179/100.1 C; 340/223; 340/328; 340/272

[51] Int. Cl.[2] ..... G08B 23/00

[58] Field of Search ..... 340/420, 221, 223, 274 R, 340/272, 421, 328; 179/100.1 C, 100.1 A

[56] References Cited

UNITED STATES PATENTS

| | | | |
|---|---|---|---|
| 2,152,296 | 3/1939 | Weis et al. | 340/221 |
| 2,595,993 | 5/1952 | Templeman et al. | 179/100.1 C |
| 2,783,327 | 2/1957 | Luckey | 340/272 |
| 3,388,390 | 6/1968 | Ciaschi | 340/221 |
| 3,509,288 | 4/1970 | Leventhal | 340/221 |
| 3,644,682 | 2/1972 | Parilla | 179/100.1 C |
| 3,938,120 | 2/1976 | O'Connell | 340/221 |

*Primary Examiner*—John W. Caldwell
*Assistant Examiner*—James J. Groody
*Attorney, Agent, or Firm*—Stonebraker, Shepard & Stephens

[57] ABSTRACT

A communication appliance is located to present predetermined information and is automatically turned on and off. A pair of switches are arranged to be actuated in sequence by a person approaching the communication appliance, and a control device responds to the proper sequence of operation of the switches to actuate the appliance to present the information to the person. The appliance can present an advertising message in a sales region or reminder messages to a person leaving a building. In one embodiment, there is a third switch, and a deenergizing tone is generated from a prerecorded tape.

6 Claims, 6 Drawing Figures

COMMUNICATION APPLIANCE OPERATING DEVICE

CROSS REFERENCE TO RELATED APPLICATION

This application is a continuation-in-part of my copending parent application, Ser. No. 569,148, filed April 17, 1975, entitled HOME REMINDER DEVICE, now abandoned.

BACKGROUND OF THE INVENTION

Before a person leaves home, it is often important to check on equipment that may be operating and remember anything that may be hazardous if left untended. This can include shutting off appliances, putting out cigarettes, or taking precautionary steps such as locking the door, putting out or confining a pet, turning on a light or radio, leaving a message for someone, etc. These details are easy to forget as a person is leaving home and concerned with the mission ahead.

The invention involves recognition of the problem of remembering details upon leaving home and proposes a simple and convenient reminder device for automatically reminding the person leaving home to check on things to be done. The invention aims at simplicity, economy, and reliability in a reminder device.

The invention also involves recognition of a way that operation of a reminder device can be applied to other circumstances to achieve other advantages. For example, a communication appliance having predetermined audio, visual, or combinations of audio and visual messages, such as an advertising device, can be operated automatically whenever a customer approaches a sales region so that the advertising message can be presented to the customer. Such a communication appliance can be a television, tape recorder, projector, movable mechanism, or a combination of these. The invention can also be applied to buildings other than a home, and can present information to security personnel or instructions or other appropriate messages to persons entering a region, as well as leaving a region.

SUMMARY OF THE INVENTION

The invention includes a communication appliance located to present predetermined information in a communication region and includes a device for operating the communication appliance. A first switch is arranged to be actuated by a person approaching the communication region, and a second switch is arranged near the first switch to be actuated before the person approaching the communication region actuates the first switch. A control means responds to operation of the second switch followed by operation of the first switch for actuating the appliance to present the information. When the information presentation is completed, the appliance is stopped and reset for another operation.

DESCRIPTION OF THE PREFERRED EMBODIMENT

The invention applies to a home reminder device for a person leaving a house and analogous communication appliances for many other purposes, such as advertising, security, and for presenting a wide variety of messages or information to people as they move from one region to another. The home reminder device will be described first, followed by a description of other applications of the invention.

Figure 1:
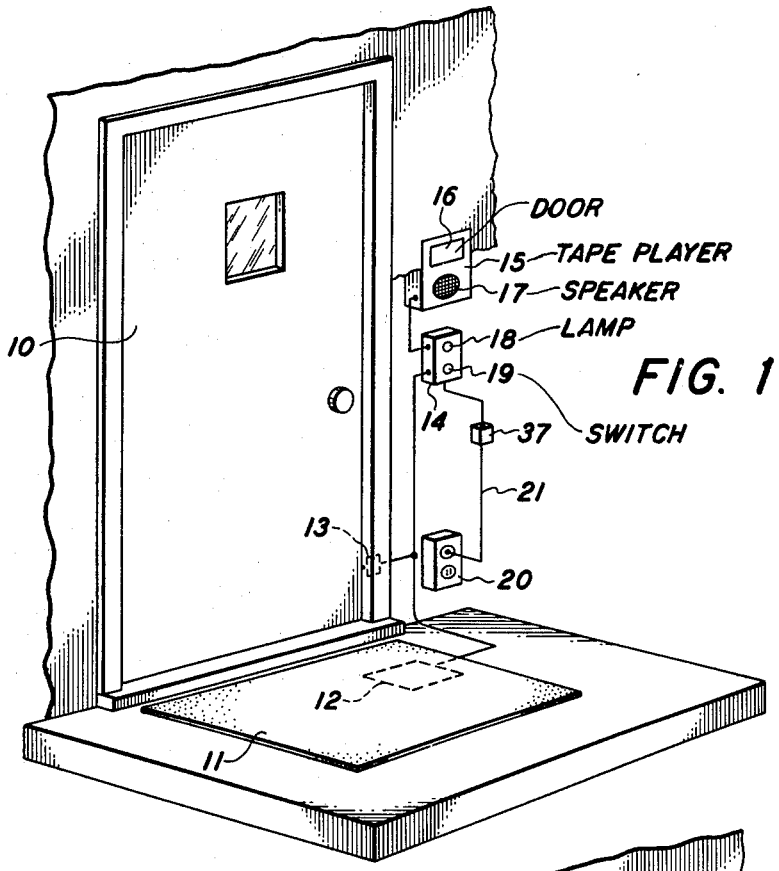
FIG. 1 is a perspective view of one preferred embodiment of the invention arranged near a door.

The inventive reminder device includes several components located near a door 10 providing an exit from the home, and the door 10 is viewed from inside the home in FIG. 1. An interior door mat 11 lies on the floor inside the door 10 and includes a mat switch 12 actuated by a person stepping on the mat 11 to exit through the door 10. Another switch 13 is actuated by opening the door 10, and the switches 12 and 13 are in circuit with a control 14 controlling the operation of a tape player 15 arranged near the door 10.

The tape player 15 has a door 16 allowing access to a pre-recorded tape message preferably in the form of an endless tape strip, and the tape player 15 includes generally known components for playing the message from a pre-recorded tape through a speaker 17. The control device 14 includes a lamp 18 indicating that the system is operating, and a preferably push-button, manual start switch 19 for turning the system on or off. The system is powered from a receptacle 20 through a conventional power cord 21.

Figure 2:
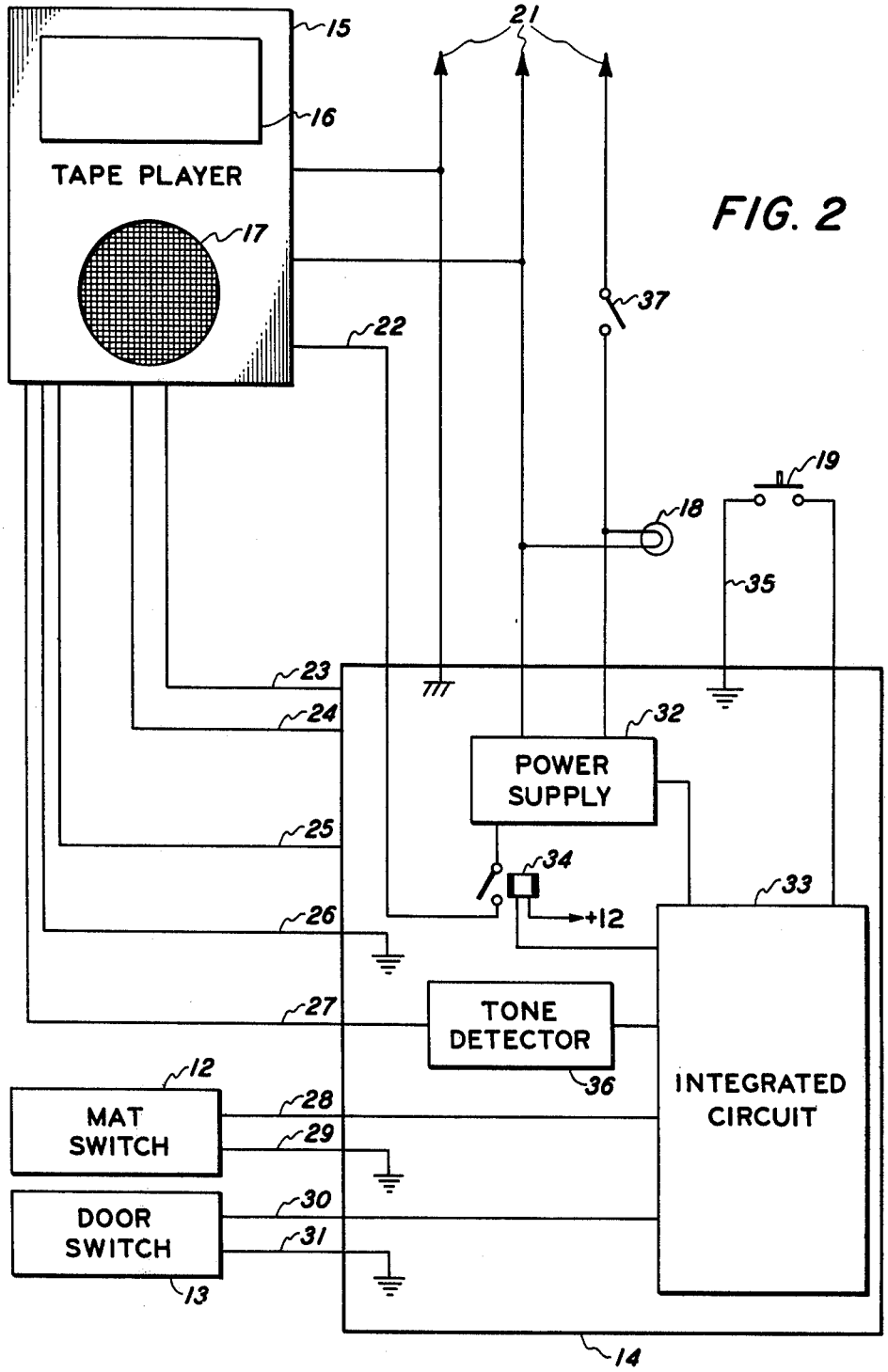
FIG. 2 is a schematic wiring diagram of the device of FIG. 1.

The interconnection of the components of the reminder device is schematically shown in FIG. 2. The control 14 is powered through the line 21 and line switch 37 and controls the power to the tape player 15 through the line 22 and the lines 23 and 24 leading to the speaker 17. The audio signal for the tape player 15 is transmitted through the lines 25 and 26, and the tape in the player 15 preferably has a pre-recorded end-of-message tone transmitted back to the control 14 through the line 27. The mat switch 12 and the door switch 13 communicate with the control 14 respectively through the lines 28 and 29 and the lines 30 and 31.

The control 14 also includes a power supply 32 and an integrated circuit 33 controlling a relay 34 to switch on the power to the tape player 15 through the line 22. The integrated circuit 33 also receives an input through the line 35 from the manual start button 19, an input through the line 28 from the mat switch 12, an input through the line 30 from the door switch 13, and an input from the tone detector 36 detecting the end-of-message tone in line 27 from the tape player 15.

Figure 3:
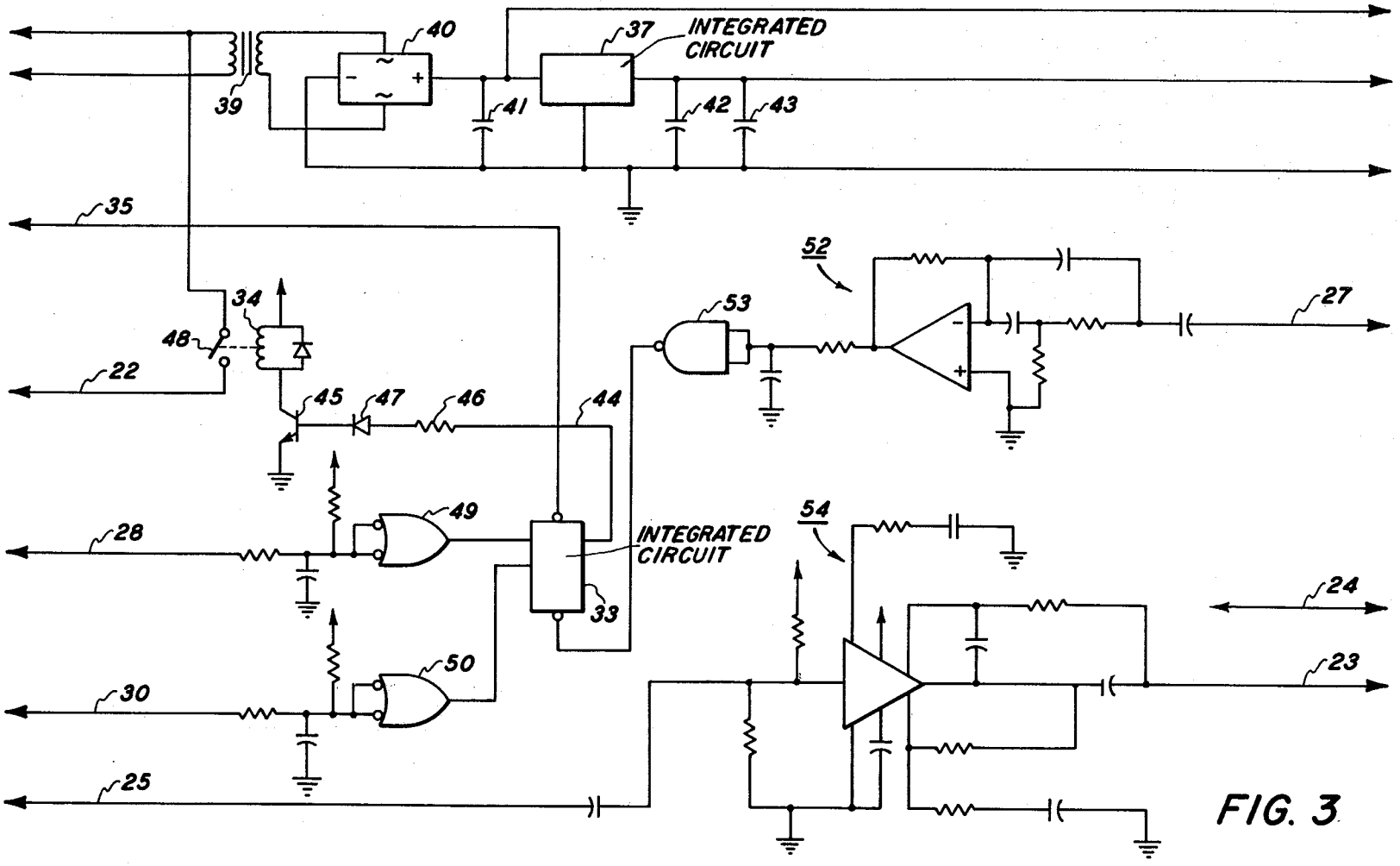
FIG. 3 is a schematic diagram of a control portion of the device of FIG. 2.

A preferred way of arranging some of the components in the control system for the inventive device is shown in FIG. 3. The power supply 32 includes a transformer 39, a rectifier 40, an integrated circuit 37, and three capacitors 41–43 providing 12v and 5v DC power for operating the necessary circuits. Integrated circuit 33 has an input through line 35 from the manual start button 19, inputs from the mat switch 12 through line 28 and the door switch 13 through the line 30, and an input from the 1000 Hz tone signal from the message tape. The output from the integrated circuit 33 in line 44 is supplied to a transistor 45 through a resistor 46 and a diode 47 to operate the relay 34 and close the switch 48 to energize the line 22 to power the tape player. The inputs from the mat switch and the door switch in lines 28 and 30 pass through respective OR gates 49 and 50 that cooperate with the integrated circuit 33 to provide an output only when the mat switch closes followed by closing of the door switch.

The end-of-message tone from the tape player is detected and amplified in a generally known amplifier circuit 52 and fed through an AND gate 53 to the integrated circuit 33 which then de-energizes the relay 34 and resets the device for another actuation. Another generally known amplifier circuit 54 amplifies the signal from the tape player and drives the speaker.

There are many different ways that control circuitry can be arranged in practicing the invention, and those skilled in the art will appreciate many specific variations that can be made. For example, circuitry for amplifying an audio signal from the magnetic head of the tape player is available in many forms for driving a speaker, a wide variety of speakers are available, and many different tape drives and magnetic heads are possible for use in the tape player. Tone detection and amplifying circuitry for the end-of-message tone is also available in several forms in other equipment, and several different forms of integrated circuits are available on the market to accomplish the preferred switching for the invention. Also, different power supplies and different forms of relays or other switching devices can be used. The components and circuits illustrated in FIG. 3 are preferred for simplicity, economy, and compactness, but other arrangements are also workable.

The components shown in the drawings and described above are arranged to operate as follows. When the control 14 is energized by closure of power line switch 37, and the manual start button 19 is closed, the device is ready to remind a person leaving the house. As the person approaches the door 10 to leave, the mat switch 12 is actuated first by the person stepping on the mat 11, and then the door switch 13 is actuated as the door 10 is opened. The circuit 33 is arranged to operate only on actuation of the switch 12 followed by actuation of the switch 13, and the circuit 33 then actuates a relay 34 to energize the tape player 15 through the line 22. This starts the tape player 15 to play the prerecorded message on its tape and make the message audible through the speaker 17 to remind the person leaving of things to be checked. For example, the reminder message may say: "Turn off stove and iron, put out cigarette, lock front door from inside." Any other appropriate warning or message may be given.

At the end of the reminder message is a pre-recorded tone signal of any convenient frequency, such as 1000 Hz, and the tone from this signal is detected by the tone detector 36 which signals circuit 33 to de-energize relay 34 and open the line 22 to stop the tape player 15 and reset the system for another actuation. The person leaving then heeds the audible reminder, checks anything not already checked, and then departs. A person entering the home through the door 10 actuates switch 13 before actuating the switch 12, and this does not operate the tape player 15.

When guests are arriving and leaving or when, for some other reason, a reminder is not desired, the system is easily shut off by the push-button switch 19. In answering the door, for example, the button 19 can be pushed before the door is opened to prevent actuation of the reminder. The lamp 18 visually indicates whether the reminder device is on or off.

Figure 4:
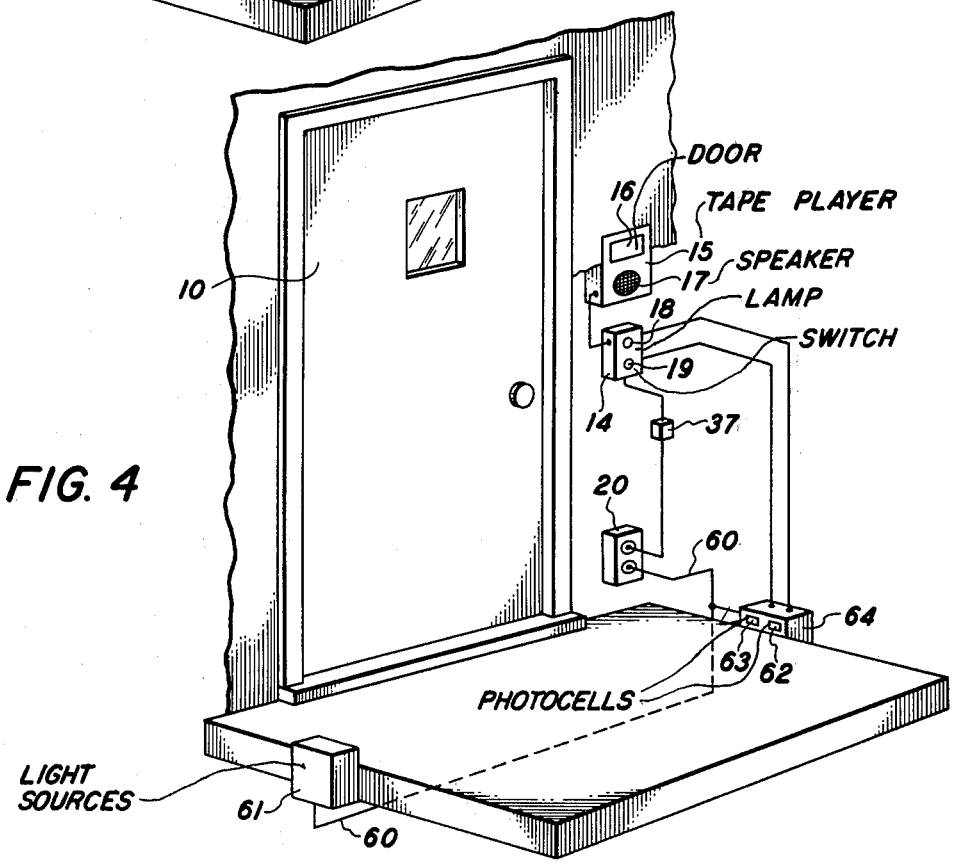
FIG. 4 is a perspective view of another preferred embodiment of the invention using photocell circuits near a door.

The reminder device can be battery operated instead of powered by house current, and the switches 12 and 13 can be arranged in other ways. One preferred alternative is shown in FIG. 4 using photocell circuits as switches. A line 60 from the receptacle 20 powers a pair of light sources in a housing 61 so that light beams are directed toward a pair of photoelectric cells 62 and 63 in a housing 64 near the door 10. A person approaching the door to leave the house first interrupts the light path to the photocell 62 and then interrupts the light path to the photocell 63 to open the photocell circuits successively in the proper order to actuate the reminder device. Except for using a pair of photocell circuits spaced a few inches apart, such an arrangement can be made similar to the photocell circuits used at the foul line of a bowling alley. The same basic principle is followed in movement of a person toward the door accomplishing successive switching to actuate the reminder device.

Other possible switching arrangements include one switch arranged in a floor mat more remote from the door than another switch in the same floor mat, or one photocell circuit near the door to be actuated before closures of a switch operated by opening of the door. The switches can also be proximity switches or other sensing devices that respond to movement of a person toward the door for leaving the home. Another possibility is one switch operated by grasping or turning the door knob, and another switch operated by opening the door. The tape player, its tape recording strip or other recording device, power supplies, and stopping and resetting mechanisms can also be varied, and reminder messages other than tape recorded messages can be used.

The various components are of well-known conventional construction, readily obtainable on the market. It is the system as a whole, and the functions the system accomplishes, that are inventive features, rather than the construction of any particular electrical or electronic component.

If this device is used in a home having a side door which the householder customarily uses when leaving the house (e.g., a door leading to a garage), then it is preferable to install this device at the customary leaving door, rather than at the main front door. The switch arrangement of two stitches operated in one sequence when leaving the house and in a reverse sequence when returning, enables the householder to return without tripping or actuating the sound tape, thus avoiding unnecessary and possibly annoying operation of the audible warning mechanism when returning, while having it fully effective upon leaving the house.

Figure 5:
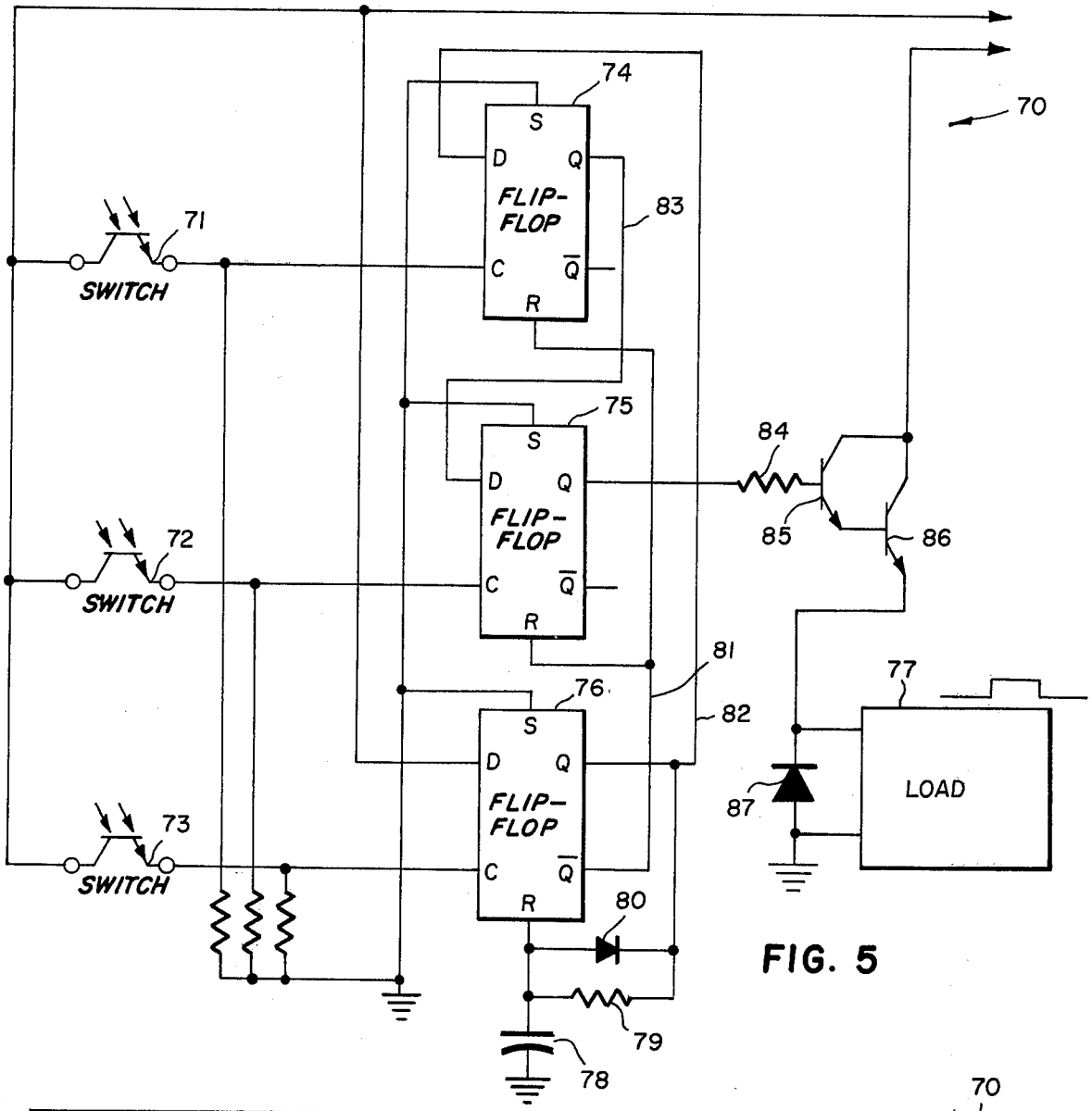
FIG. 5 is a schematic diagram of an alternative switching arrangement using three switches and a timer.

Switching arrangement 70 of FIG. 5 uses three light sensitive transistor switches 71–73 in circuit with three bi-stable flipflops 74–76 for automatically operating a communication appliance 77, which can be a tape recorder, phonograph, television, projector, mechanically movable device, or a combination of such elements. The switch 73 controls the output state of flipflop 76, which is in circuit with the capacitor 78, the resistor 79, and the diode 80 to form an RC timing circuit. In the normal, inactive state of the switch 73 and the flipflop 76, an output in the line 81 is applied to the flipflops 74 and 75 to hold them in an inoperable state so that the appliance 77 cannot be turned on. When the switch 73 is actuated, the flipflop 76 changes state for an interval timed by the capacitor 78 and the resistor 79 of for example a minute or two, and an output is applied through the line 82 to enable the flipflop 74.

To produce an output actuating the appliance 77, the switch 71 must be actuated followed by actuation of the switch 72. When the switch 71 is actuated, the flipflop 74 changes state and applies an output through the line 83 to enable the flipflop 75. Then if the switch 72 is actuated within the interval set by the capacitor 78 and the resistor 79, the flipflop 75 changes state and produces an output through the resistor 84 and the amplifying transistors 85 and 86 to actuate the appliance 77 through the diode 87.

The addition of the switch 73 and the timing circuit formed by the capacitor 78 and the resistor 79 sets a time limit for proper sequential operation of the switches 71 and 72, and the switching circuitry 70 is also simpler, less expensive, and draws less power to result in advantageous and automatic operation of the appliance 77.

Figure 6:
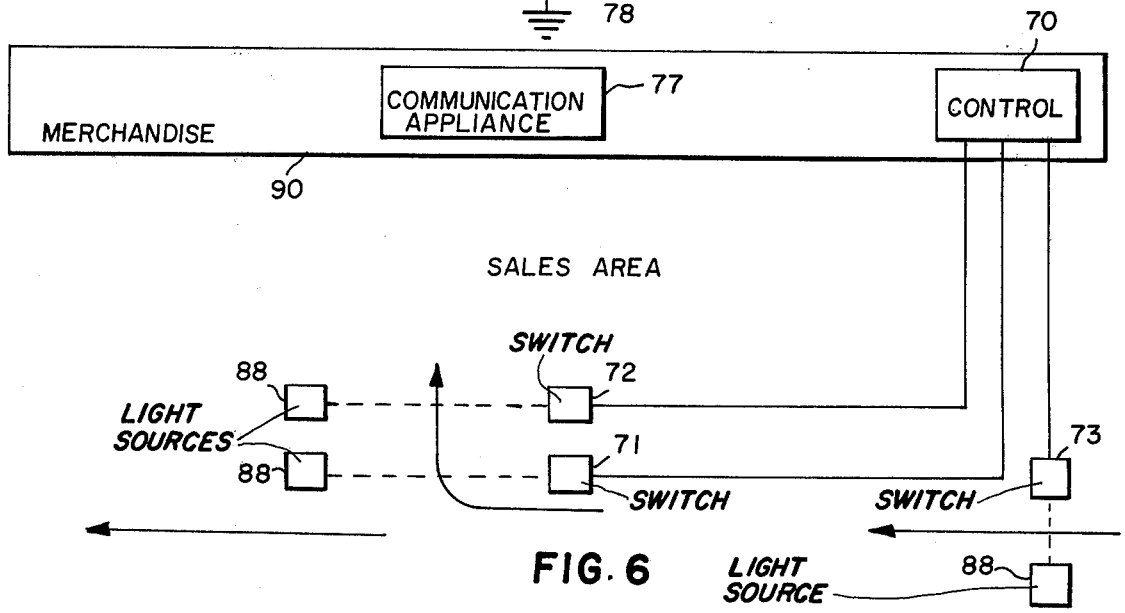
FIG. 6 is a schematic plan view of application of the invention to a communication appliance for advertising purposes.

As mentioned above, the invention can be applied to many different communication appliances for many different purposes including advertising or sales messages, instructions to people moving from one region to another, and security messages. One possible arrangement for advertising purposes is illustrated in FIG. 6 using the switching control system 70 of FIG. 5 and the switches 71–73. The light sources 88 direct light on the switches 71–73 which change state when the light beam is interrupted. The switch 73 is arranged to respond to persons moving along a main path of travel as represented by the straight arrows, and the switches 71 and 72 are arranged to respond to any person turning into the sales area 89. In this region, merchandise is shown in a display 90 and the appliance 77 is arranged to be viewed or heard. As a person sequentially interrupts a beam to the switch 71 and then to the switch 72 in approaching the sales area 89, the control 70 automatically turns on the appliance 77 to present an advertising message. When the presented information is completed, the appliance 77 is stopped as previously explained and reset for another actuation. The automatic operation of the appliance 77 is then accomplished only when a prospective customer approaches the sales area 89, and the appliance 77 is not operated needlessly when no one is around, and does not require the customer or a sales person to manually start the appliance 77.

Those who are skilled in the art will appreciate many ways that the invention can be applied to operation of various communication appliances to present various predetermined information. They will also be able to arrange the invention in many different ways in different places to accomplish various desired objectives.

What is claimed is:

1. A home reminder device for reminding a person about to leave a home through a door of precautions to take before leaving, said device comprising a. a tape player located in the region of said door and having a speaker and a prerecorded reminder message;

b. first switch means arranged in the region of said door to be actuated by a person leaving said home through said door;

c. second switch means arranged in the region of said first switch means to be actuated by said person leaving said home before said person leaving said home actuates said first switch means;

d. control means responsive to operation of said second switch means followed by operation of said first switch means as indicating a person preparing to leave through said door, for actuating said tape player to play said message through said speaker as a reminder to such person;

e. means for stopping said tape player at the end of said prerecorded message and resetting said control means for another cycle of operation;

f. a manually operable switch adjacent said door for rendering said control means inoperative so that a person within said home may operate said manual switch to prevent playing said reminder message when opening said door to admit a visitor; and g. a signal light adjacent said manually operable switch for indicating visually the operative or inoperative state of said control means.

2. The device of claim 1 wherein said second switch means is more remote from said door than said first switch means.

3. The device of claim 1 wherein said first switch means is actuated by opening said door.

4. The device of claim 1 wherein said second switch means is a mat switch actuated by weight of a person stepping on a mat when approaching said door from within said house.

5. The device of claim 1 wherein said stopping and resetting means includes a prerecorded tone at the end of said reminder message and also includes means for detecting said tone.

6. The device of claim 1 wherein one of said switch means includes a photocell responsive to a beam of light in position to be obstructed by movement of said person toward and relatively close to said door.

* * * * *